US011502444B2

(12) United States Patent
Sundarakrishnamachari et al.

(10) Patent No.: US 11,502,444 B2
(45) Date of Patent: Nov. 15, 2022

(54) ELECTRICAL CONNECTOR ASSEMBLY HAVING A MALE BLADE STABILIZER WITH INTEGRATED PRIMARY LOCK REINFORCEMENT

(71) Applicant: Aptiv Technologies Limited, St. Michael (BB)

(72) Inventors: Rangarajan Sundarakrishnamachari, Chennai (IN); Sivakumar Jogula, Nagar Kurnool (IN); Shawna Higgins, Youngstown, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 45 days.

(21) Appl. No.: 17/127,135

(22) Filed: Dec. 18, 2020

(65) Prior Publication Data

US 2021/0226370 A1 Jul. 22, 2021

Related U.S. Application Data

(60) Provisional application No. 62/961,733, filed on Jan. 16, 2020.

(51) Int. Cl.

| | |
|---|---|
| ***H01R 13/436*** | (2006.01) |
| ***H01R 13/502*** | (2006.01) |
| ***H01R 43/20*** | (2006.01) |

(52) U.S. Cl.

CPC ..... *H01R 13/4368* (2013.01); *H01R 13/502* (2013.01); *H01R 43/20* (2013.01)

(58) Field of Classification Search

CPC ..... H01R 13/4364; H01R 13/4365; H01R 13/502; H01R 43/20

See application file for complete search history.

(56) References Cited

U.S. PATENT DOCUMENTS

| | | | | |
|---|---|---|---|---|
| 4,826,452 A | | 5/1989 | Sian et al. | |
| 4,986,758 A | * | 1/1991 | Wakata | H01R 13/4365 439/378 |
| 5,575,685 A | * | 11/1996 | Ittah | H01R 13/4365 439/595 |
| 5,716,234 A | * | 2/1998 | Phillips | H01R 13/4365 439/595 |
| 6,761,568 B2 | | 7/2004 | Bakker et al. | |
| 7,179,136 B1 | | 2/2007 | Morello | |
| 8,038,455 B1 | | 10/2011 | Moraes et al. | |

(Continued)

OTHER PUBLICATIONS

Extended European Search Report for EP Application No. 21150468.3, dated May 19, 2021, 8 pages.

*Primary Examiner* — Oscar C Jimenez

(74) *Attorney, Agent, or Firm* — Billion & Armitage

(57) ABSTRACT

An electrical connector assembly includes a connector body defining a terminal cavity therein and a male terminal projecting along a terminal axis to a tip and secured within the terminal cavity by a primary lock feature. The electrical connector assembly also includes a terminal stabilizer defining an aperture that is disposed within the connector body and is moveable from a pre-staged position to a staged position. The electrical connector assembly further includes a primary lock retaining feature that is integrated with the terminal stabilizer and is configured to engage the primary lock feature as the terminal stabilizer moves from the pre-staged position to the staged position.

18 Claims, 6 Drawing Sheets

(56) References Cited

U.S. PATENT DOCUMENTS

| | | | | |
|---|---|---|---|---|
| 8,267,702 | B2 | 9/2012 | De et al. | |
| 8,926,344 | B2 | 1/2015 | Jozwiak et al. | |
| 9,054,454 | B2 * | 6/2015 | Gomez | H01R 13/631 |
| 10,236,629 | B2 | 3/2019 | Narro et al. | |
| 2009/0311896 | A1 * | 12/2009 | Myer | H01R 13/4223 439/248 |

* cited by examiner

ELECTRICAL CONNECTOR ASSEMBLY HAVING A MALE BLADE STABILIZER WITH INTEGRATED PRIMARY LOCK REINFORCEMENT

CROSS-REFERENCE TO RELATED APPLICATION

This application claims benefit of priority to U.S. Provisional Patent Application No. 62/961,733 filed on Jan. 16, 2020, the entire disclosure of which is hereby incorporated by reference.

TECHNICAL FIELD

The invention generally relates to an electrical connector assembly, particularly to a connector assembly having a male blade stabilizer (MBS) with an integrated Primary Lock Reinforcement (PLR).

BACKGROUND

In electrical connection assemblies, especially those used in automotive application, secondary locking system plays a key role in ensuring terminals are properly positioned and protecting terminals in the case of a primary lock failure due to high connector engagement force. A Male Blade Stabilizer (MBS) system is often used to protect the male pins from damage by external objects. The MBS is movable from a pre-staged position to a staged position. The MBS may be configured to returnable from the staged position to the pre-staged position or may remain permanently in the staged position. Electrical connector systems may also incorporate an Independent Secondary Lock (ISL) system that is used to back up the primary lock system for terminals in case of a primary lock failure.

The subject matter discussed in the background section should not be assumed to be prior art merely because of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY

According to one or more aspects of the present disclosure, an electrical connector assembly includes a first connector body defining a first terminal cavity therein, a male terminal projecting along a terminal axis to a tip and secured within the first terminal cavity by a first primary lock feature, and a terminal stabilizer defining an aperture, disposed within the first connector body, and moveable from a pre-staged position to a staged position. The tip of the male terminal is received in the aperture. The terminal stabilizer is closer to the tip in the pre-staged position than the staged position. The terminal stabilizer defines a first primary lock retaining feature configured to engage the first primary lock feature as the terminal stabilizer moves from the pre-staged position to the staged position.

In one or more embodiments of the electrical connector assembly according to the previous paragraph, the first primary lock retaining feature is disengaged from the first primary lock feature when the terminal stabilizer is in the pre-staged position.

In one or more embodiments of the electrical connector assembly according to any one of the previous paragraphs, the first primary lock retaining feature is received within the first terminal cavity as the terminal stabilizer is moved from the pre-staged position to the staged position.

In one or more embodiments of the electrical connector assembly according to any one of the previous paragraphs, the first primary lock retaining feature is a first rib feature extending parallel to the terminal axis from a first face of the terminal stabilizer defining the aperture.

In one or more embodiments of the electrical connector assembly according to any one of the previous paragraphs, the electrical connector assembly further includes a second connector body defining a second terminal cavity therein and configured to mate with the first connector body and a female terminal secured within the second terminal cavity by a second primary lock feature and configured to mate with the male terminal. The terminal stabilizer defines a second primary lock retaining feature configured to engage the second primary lock feature as the terminal stabilizer moves from the pre-staged position to the staged position as the first connector body is mated with the second connector body.

In one or more embodiments of the electrical connector assembly according to any one of the previous paragraphs, the second primary lock retaining feature is a second rib feature extending parallel to the terminal axis from a second face of the terminal stabilizer defining the aperture in a direction opposite to the first face.

In one or more embodiments of the electrical connector assembly according to any one of the previous paragraphs, the second connector body pushes the terminal stabilizer from the pre-staged position to the staged position as the first connector body is mated with the second connector body.

In one or more embodiments of the electrical connector assembly according to any one of the previous paragraphs, the terminal stabilizer defines pre-stage locking features configured to retain the terminal stabilizer in the pre-staged position until pushed by the second connector body.

In one or more embodiments of the electrical connector assembly according to any one of the previous paragraphs, the first primary lock retaining feature engages the first primary lock feature prior to mating the male terminal with the female terminal.

In one or more embodiments of the electrical connector assembly according to any one of the previous paragraphs, the second primary lock retaining feature engages the second primary lock feature prior to mating the male terminal with the female terminal.

In one or more embodiments of the electrical connector assembly according to any one of the previous paragraphs, the terminal stabilizer defines a retraction feature configured to move the terminal stabilizer from the staged position to the pre-staged position as the first connector body is unmated from the second connector body.

According to one or more aspects of the present disclosure, an electrical connector assembly includes a first connector body defining a first terminal cavity therein, a male terminal projecting along a terminal axis to a tip and secured within the first terminal cavity by a first primary lock feature, and a terminal stabilizer defining an aperture. The terminal stabilizer is disposed within the first connector body and is moveable from a pre-staged position to a staged position. The terminal stabilizer defines a means for engaging the first primary lock feature as the terminal stabilizer moves from the pre-staged position to the staged position.

According to one or more aspects of the present disclosure, a method of assembling an electrical connector having a connector body defining a terminal cavity therein, a male terminal projecting along a terminal axis to a tip and secured within the terminal cavity by a primary lock feature, and a terminal stabilizer defining an aperture disposed within the connector body and having a primary lock retaining feature integrated with the terminal stabilizer is provided. The method includes the steps of moving the terminal stabilizer from a pre-staged position to a staged position and engaging the primary lock retaining feature with the primary lock feature as the terminal stabilizer moves from the pre-staged position to the staged position.

In one or more embodiments of the method according to the previous paragraph, the method further includes the step of receiving the tip of the male terminal in the aperture.

In one or more embodiments of the method according to any one of the previous paragraphs, the terminal stabilizer is closer to the tip in the pre-staged position than the staged position.

In one or more embodiments of the method according to any one of the previous paragraphs, the primary lock retaining feature is disengaged from the primary lock feature when the terminal stabilizer is in the pre-staged position.

In one or more embodiments of the method according to any one of the previous paragraphs, the method further includes the step of receiving the primary lock retaining feature within the terminal cavity as the terminal stabilizer is moved from the pre-staged position to the staged position.

In one or more embodiments of the method according to any one of the previous paragraphs, the primary lock retaining feature is a rib feature extending parallel to the terminal axis from a face of the terminal stabilizer defining the aperture.

BRIEF DESCRIPTION OF THE DRAWINGS

The present invention will now be described, by way of example with reference to the accompanying drawings, in which.

DETAILED DESCRIPTION

An electrical connector assembly is presented herein. The electrical connector assembly includes a terminal stabilizer that is configured to hold electrical terminals is proper spacing and alignment as the connectors of the electrical connector assembly are mated. Such a terminal stabilizer often referred to as a male blade stabilizer device since it is typically male blade terminals that require stabilization due to their elongated blades or pins. The terminal stabilizer also includes primary lock retention features that engage with the primary lock features that retain the terminals within the terminal cavities of the connectors. The lock retention features are configured to engage both the primary lock features that retain the male terminals within one connector body and the primary lock features that retain the female terminals within the other connector body.

Figure 1A:
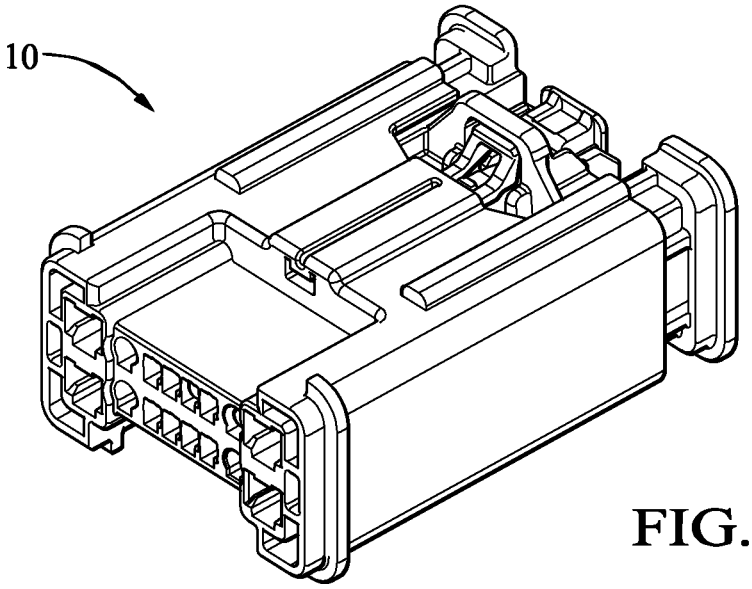
FIG. 1A is a perspective view of an electrical connector assembly in accordance with an embodiment of the invention.

FIG. 1A illustrates a non-limiting example of an electrical connector assembly, hereinafter referred to as the assembly 10, in accordance with one embodiment of the invention. The assembly 10 includes two mating connectors 12, 14 shown separately in FIGS. 1B and 1C.

Figure 1B:
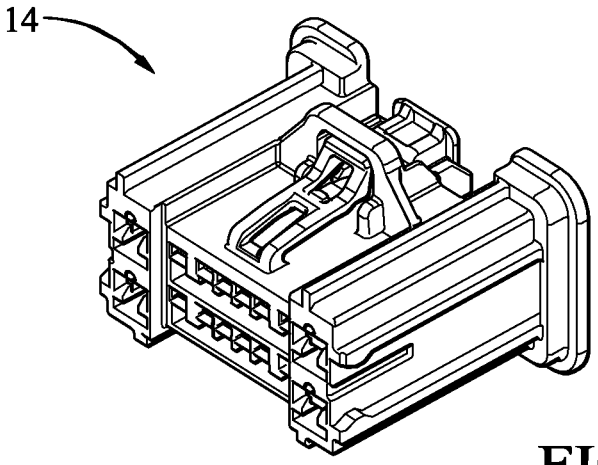
FIG. 1B is perspective view of a female connector of the electrical connector assembly of FIG. 1A in accordance with an embodiment of the invention.
Figure 1C:
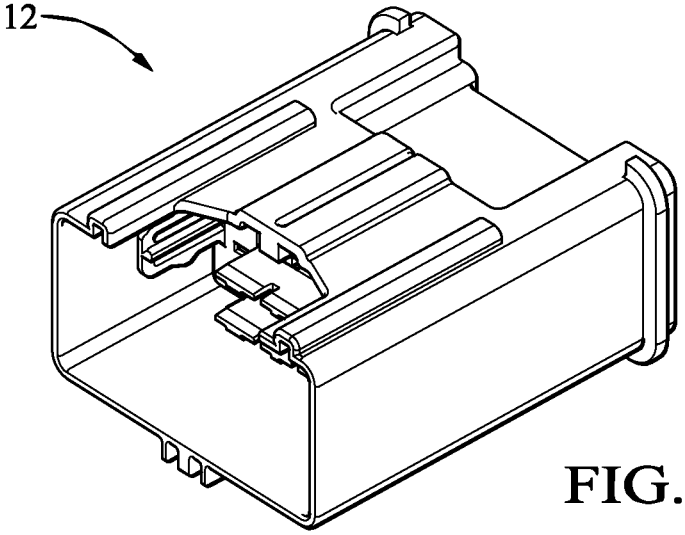
FIG. 1C is perspective view of a male connector of the electrical connector assembly of FIG. 1A in accordance with an embodiment of the invention.
Figure 2A:
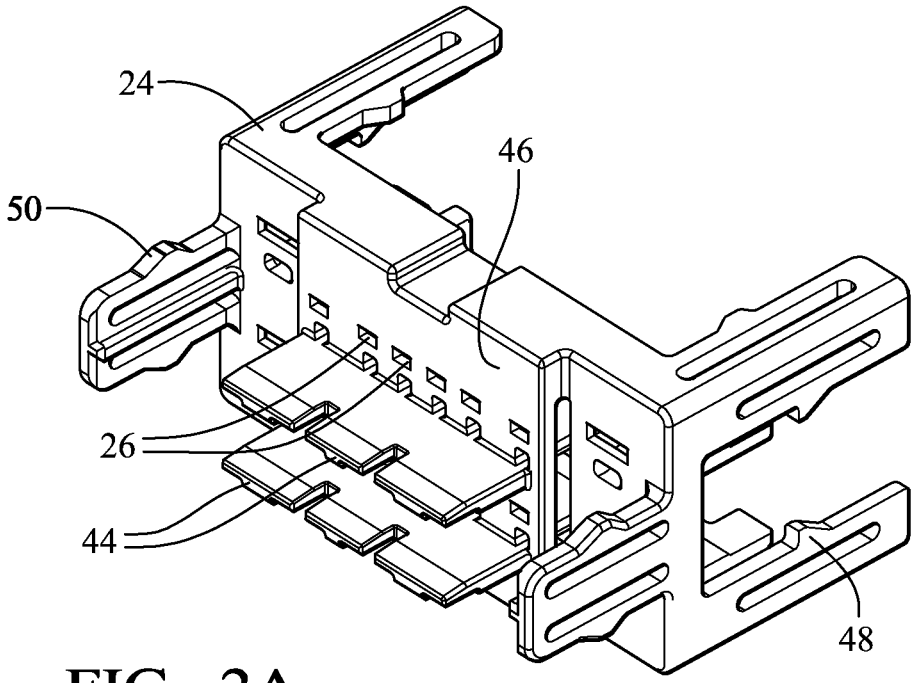
FIG. 2A is perceptive rear view of a male blade stabilizer of the male connector of FIG. 1C in accordance with the embodiment of the invention.
Figure 2B:
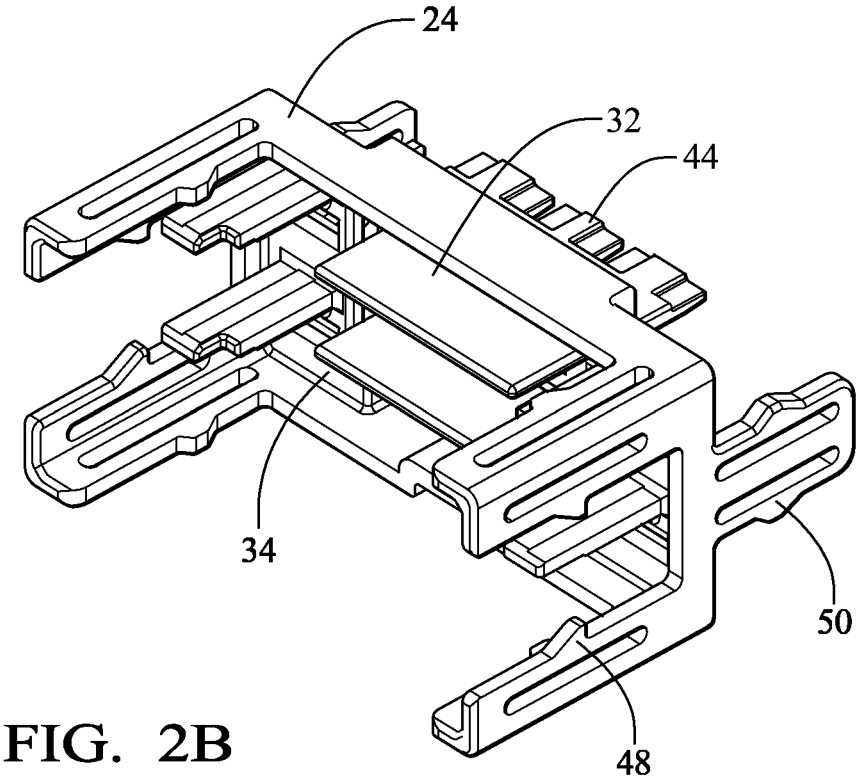
FIG. 2B is perceptive front view of the male blade stabilizer of FIG. 2A in accordance with the embodiment of the invention.
Figure 3A:
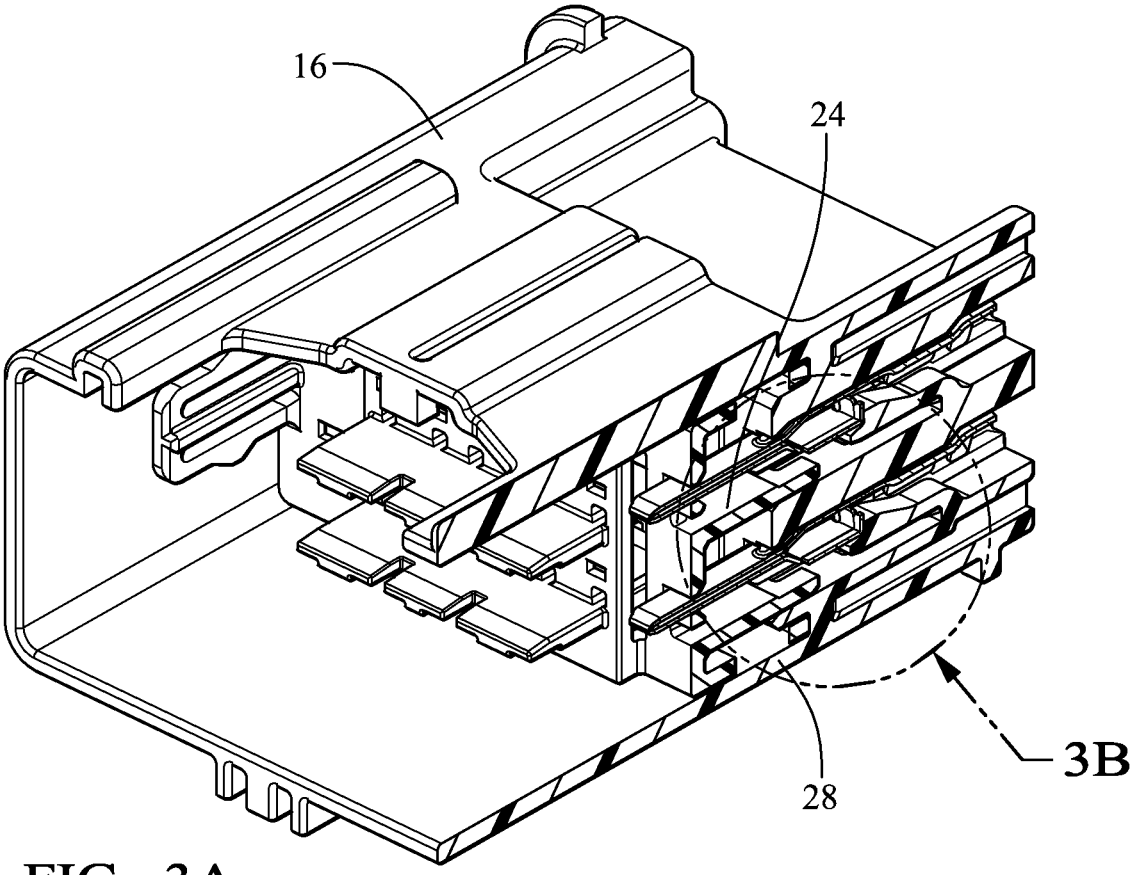
FIG. 3A is a cross section view of the male connector of FIG. 1C with the male blade stabilizer of FIG. 2A in a pre-staged position in accordance with the embodiment of the invention.
Figure 3B:
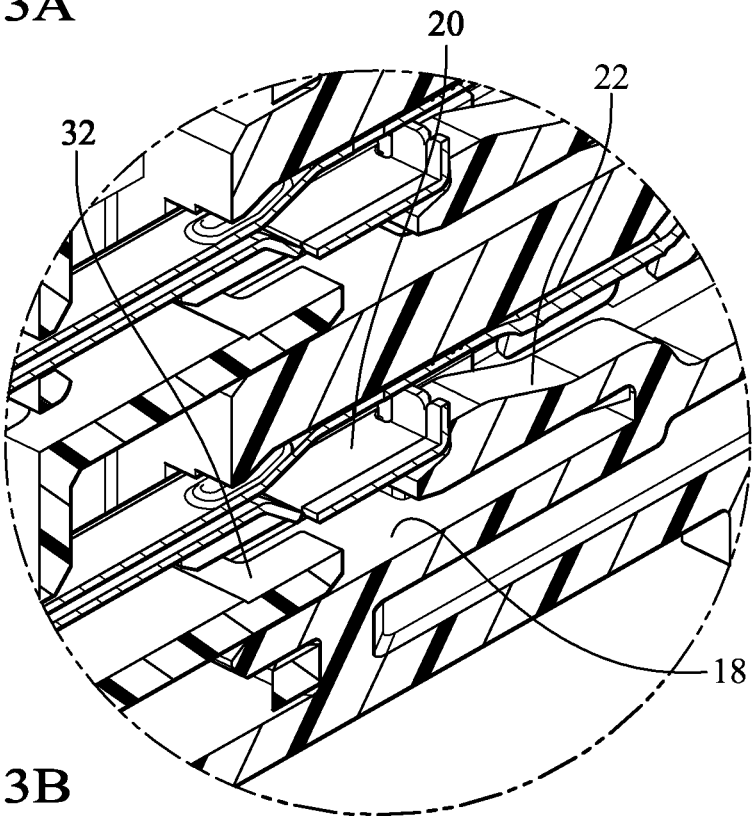
FIG. 3B is a close-up cross section view of FIG. 3A showing the engagement of the male blade stabilizer with the terminals in the pre-staged position in accordance with the embodiment of the invention.
Figure 6A:
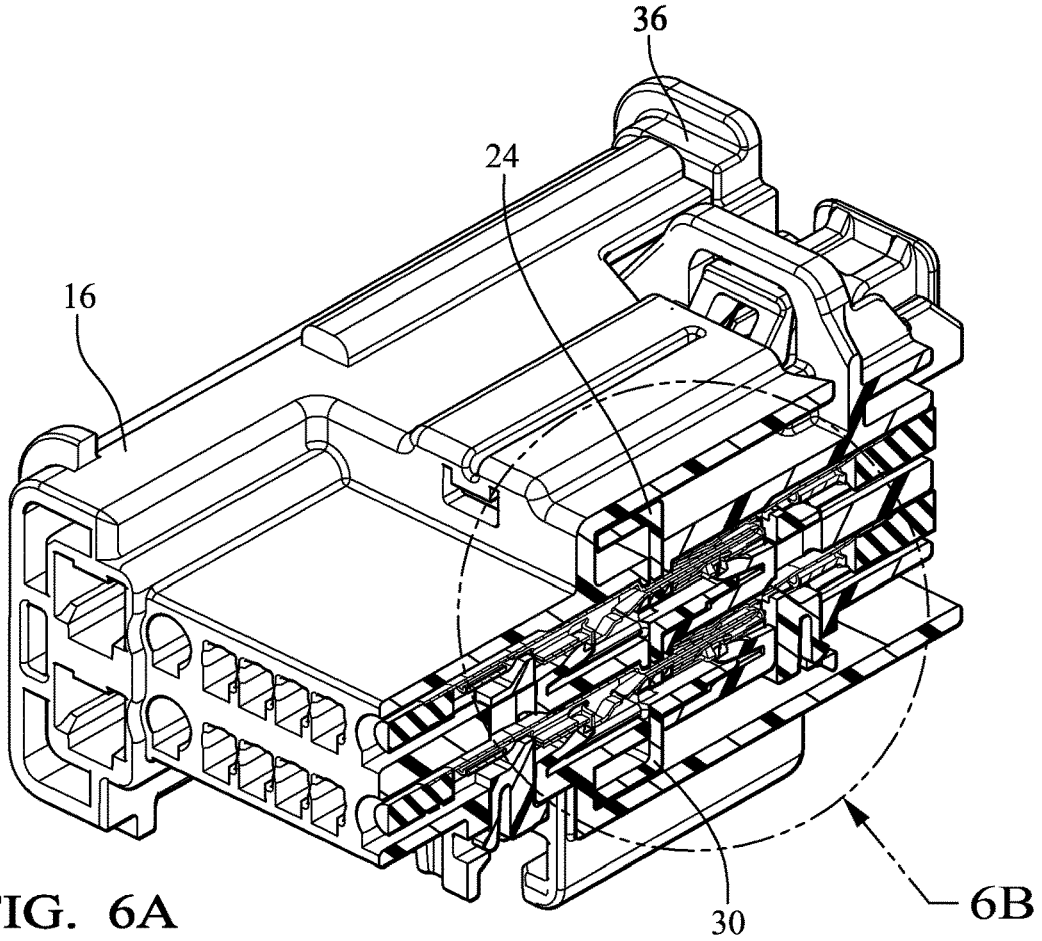
FIG. 6A is a cross section view of the female connector of FIG. 1B engaged with the male connector of FIG. 1C with the male blade stabilizer of FIG. 2A in the staged position in accordance with the embodiment of the invention.
Figure 6B:
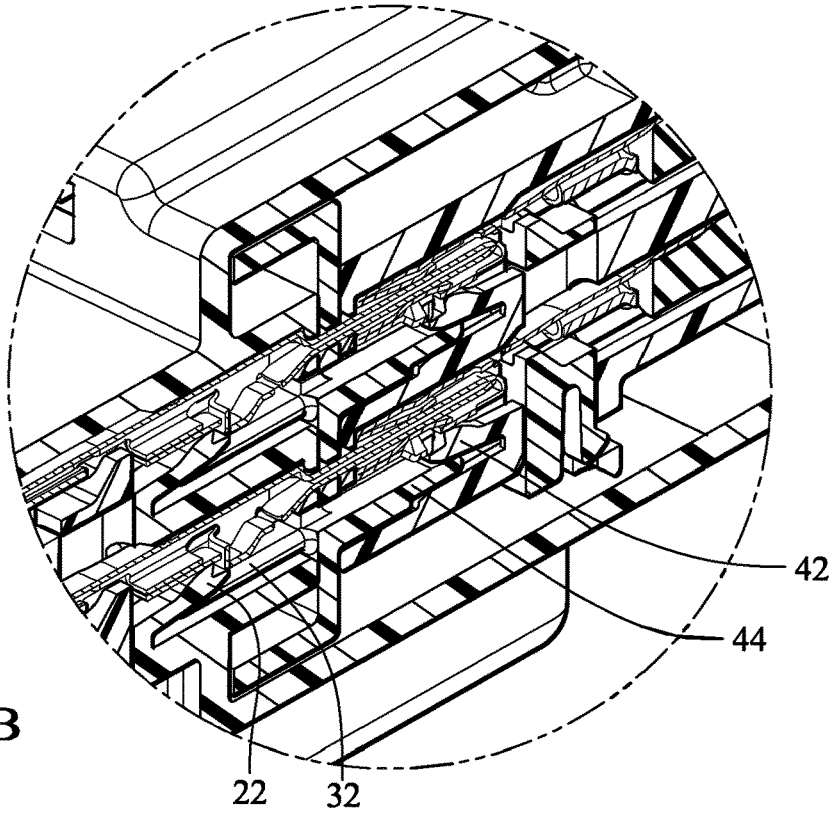
FIG. 6B is a close-up cross section view of FIG. 5A showing the engagement of the male blade stabilizer with the female and male connector in accordance with the embodiment of the invention.

A first connector 12, shown in FIG. 1C, includes a first connector body 16 defining a plurality of first terminal cavities 18 therein. The first connector 12 also includes a plurality of male terminals 20 that project along a terminal axis to a tip and are disposed within the first terminal cavities 18. The male terminals 20 are secured within the first terminal cavities 18 by first primary lock features 22 that are in the form of cantilevered arms with angled latches on the free ends that engage ledges on the male terminals 20 to secure the male terminals 20 within the first terminal cavities 18. The first connector 12 also includes a terminal stabilizer 24 shown in FIGS. 2A and 2B which defines a plurality of apertures 26 in which the male terminals 20 are received. The terminal stabilizer 24 is disposed within the first connector body 16 and moveable from a pre-staged position 28 shown in FIGS. 3A and 3B to a staged position 30 shown in FIGS. 6A and 6B. The terminal stabilizer 24 is closer to the tips of the male terminals 20 when in the pre-staged position 28 than the staged position 30.

The terminal stabilizer 24 defines a first primary lock retaining feature 32 that is configured to engage the first primary lock features 22 as the terminal stabilizer 24 moves from the pre-staged position 28 to the staged position 30. The first primary lock retaining feature 32 is situated between the first primary lock features 22 and a cavity wall of the first terminal cavities 18 when the terminal stabilizer 24 is in the staged position 30, thereby inhibiting flexing of the first primary lock features 22 that could result in inadvertent removal of a male terminal 20 from one of the first terminal cavities 18.

The first primary lock retaining feature 32 is shaped, sized, and arranged so that it is disengaged from the first primary lock features 22 when the terminal stabilizer 24 is in the pre-staged position 28. The first primary lock retaining feature 32 is received within the first terminal cavity 18 and positioned between the first primary lock features 22 and the cavity wall as the terminal stabilizer 24 is moved from the pre-staged position 28 to the staged position 30. The first primary lock retaining feature 32 is in the form of a first rib feature extending parallel to the terminal axis from a first face 34 of the terminal stabilizer 24 defining the apertures 26.

A second connector 14, shown in FIG. 1B, includes a second connector body 36 defining a plurality of second terminal cavities 38 therein. The second connector body 36 is configured to mate with the first connector body 16. A plurality of female terminals 40 are secured within the second terminal cavities 38 by second primary lock features 42 that are similar in design and function to the first primary lock features 22. The female terminals 40 are configured to mate with the male terminals 20. The terminal stabilizer 24 defines a second primary lock retaining feature 44 that is configured to engage the second primary lock features 42 as the terminal stabilizer 24 moves from the pre-staged position 28 to the staged position 30 as the first connector body 16 is mated with the second connector body 36. When the terminal stabilizer 24 is in the staged position 30, the second primary lock retaining feature 44 is situated between the second primary lock features 42 and a cavity wall of the second terminal cavities 38, thereby inhibiting flexing of the first primary lock features 22 that could result in inadvertent removal of a female terminal 40 from one of the second terminal cavities 38. The second primary lock retaining feature 44 is in the form of a second rib feature that extends parallel to the terminal axis from a second face 46 of the terminal stabilizer 24 defining the apertures 26 in a direction opposite to the first face 34.

The second connector body 36 pushes the terminal stabilizer 24 from the pre-staged position 28 to the staged position 30 as the first connector body 16 is mated with the second connector body 36.

The terminal stabilizer 24 defines pre-stage locking features 48 configured to retain the terminal stabilizer 24 in the pre-staged position 28 until pushed by the second connector body 36.

Figure 4A:
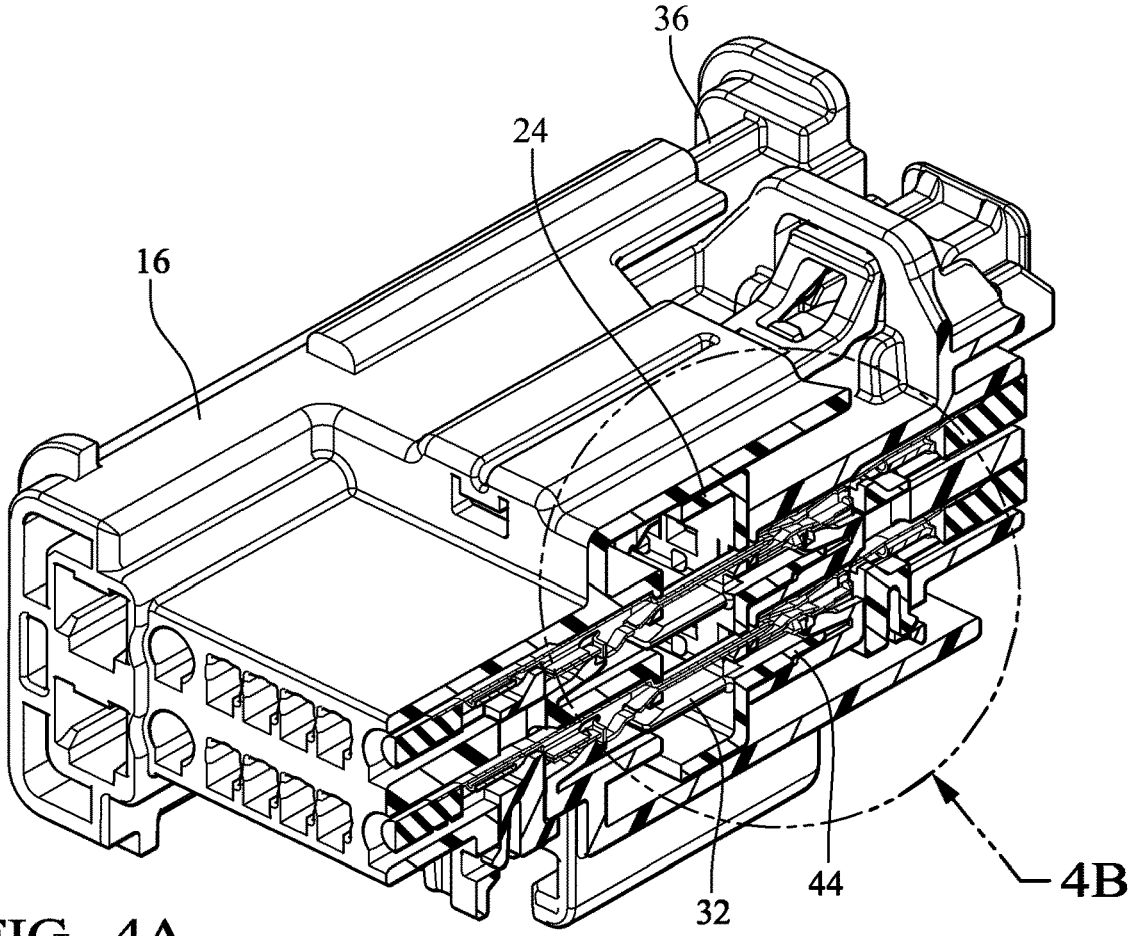
FIG. 4A is a cross section view of the female connector of FIG. 1B engaged with the male connector of FIG. 1C with the male blade stabilizer of FIG. 2A in the pre-staged position in accordance with the embodiment of the invention.
Figure 4B:
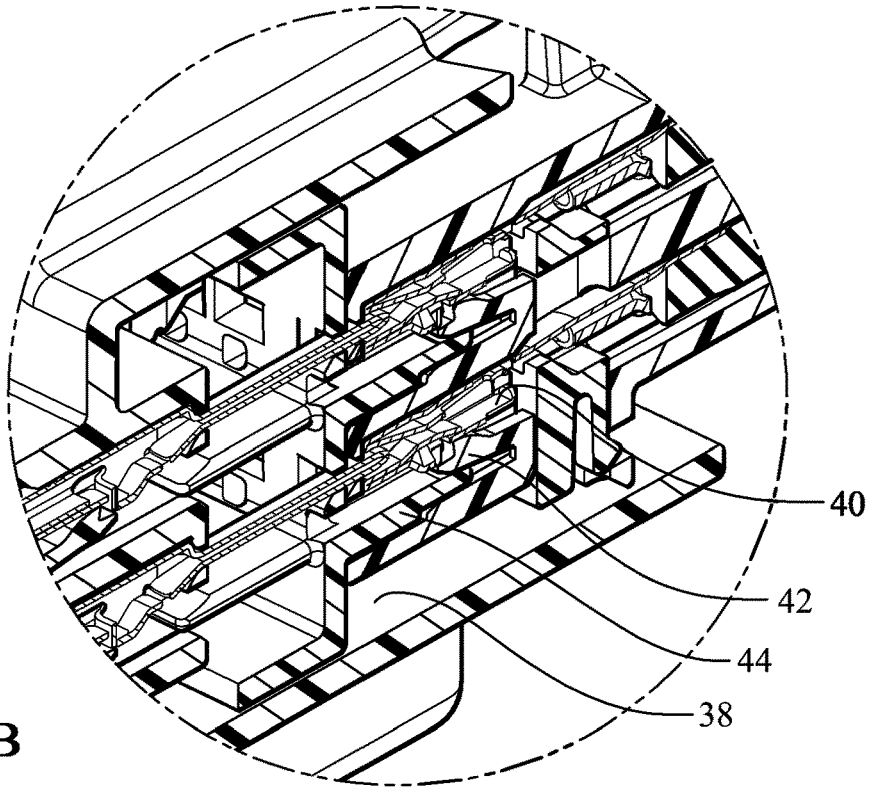
FIG. 4B is a close-up cross section view of FIG. 4A showing the engagement of the male blade stabilizer with the cavity in the female connector in accordance with the embodiment of the invention.
Figure 5A:
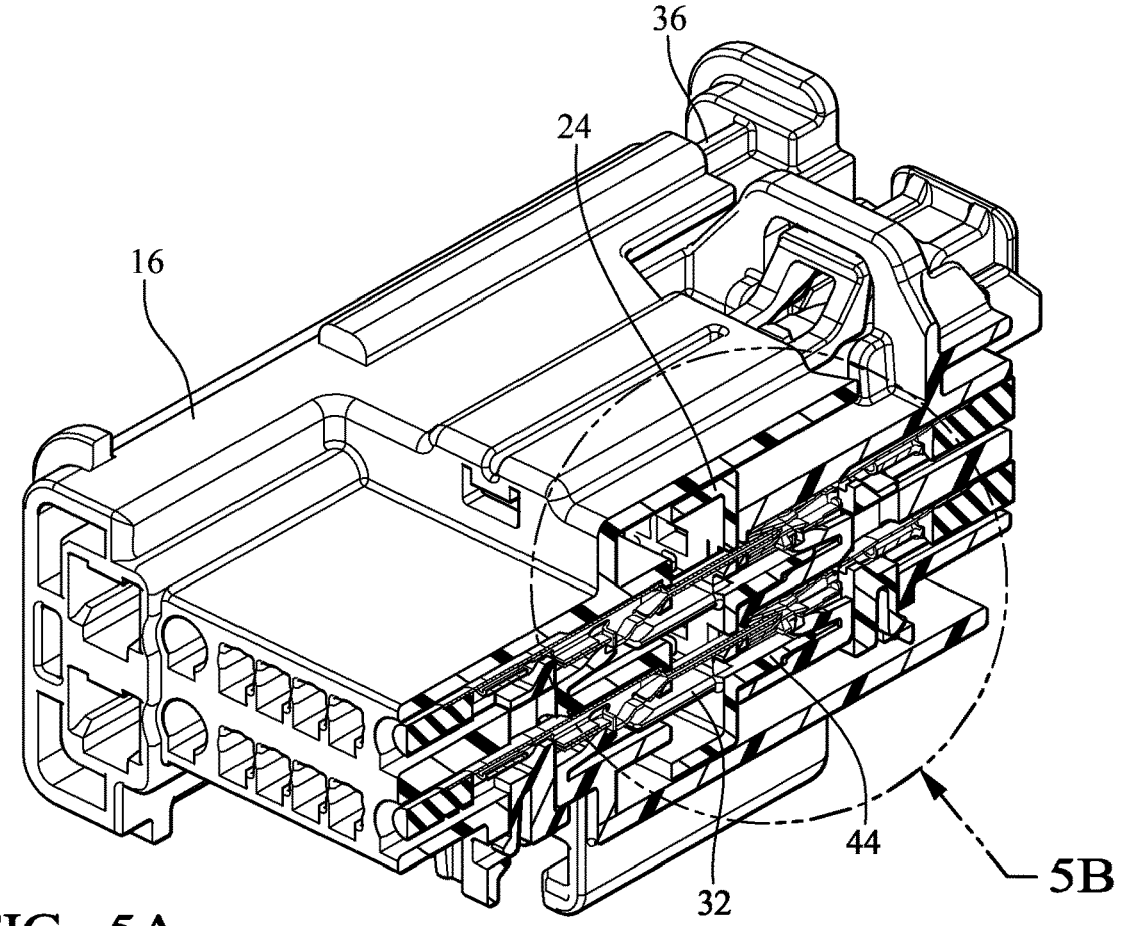
FIG. 5A is a cross section view of the female connector of FIG. 1B engaged with the male connector of FIG. 1C as the male blade stabilizer moves from the pre-staged position to the staged position in accordance with the embodiment of the invention.
Figure 5B:
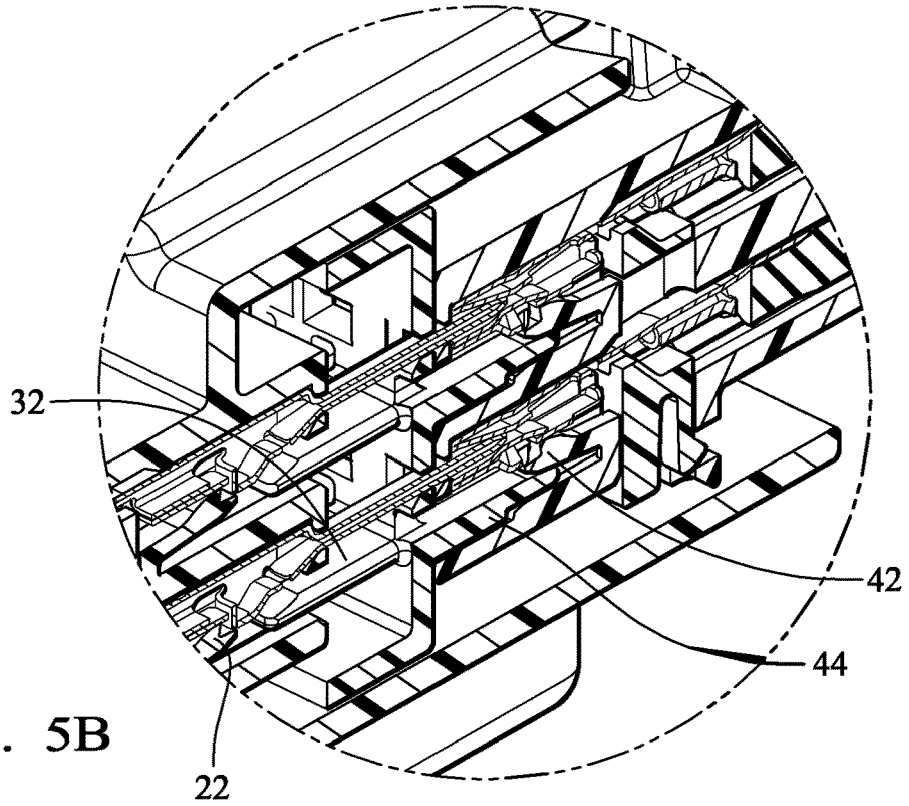
FIG. 5B is a close-up cross section view of FIG. 5A showing the male primary lock retainer backing up the male cavities primary lock before terminals are mated in accordance with the embodiment of the invention.

The first primary lock retaining feature 32 engages the first primary lock feature 22 prior to mating the male terminal 20 with the female terminal 40 as shown in FIGS. 5A and 5B. The second primary lock retaining feature 44 also engages the second primary lock feature 42 prior to mating the male terminal 20 with the female terminal 40 as shown in FIGS. 4A and 4B.

The terminal stabilizer 24 defines a retraction feature 50 configured to move the terminal stabilizer 24 from the staged position 30 to the pre-staged position 28 as the first connector body 16 is unmated from the second connector body 36.

During initial assembly, the terminal stabilizer 24 is set in the pre-stage position within the first connector body 16. The first primary lock retention features are set at some distance from the first primary lock features 22 to allow the first primary lock features 22 to flex so that the male terminals 20 may plugged into the first terminal cavities 18 without issues. During mating of the first connector 12 with the second connector 14, the second primary lock retainer feature goes between the second primary lock features 42 and the cavity wall of the second terminal cavities 38 and reinforces second primary lock features 42 to make it a positive lock system. The female housing pushes the terminal stabilizer 24 all the way down to final position.

During the movement of the terminal stabilizer 24 from the pre-staged position 28 to the staged position 30, the first primary lock retaining feature 32 backs up the first primary lock features 22 before the male terminals 20 start mating with the female terminals 40. This ensures that the first primary lock features 22 are very well reinforced before terminal engagement which can exert higher forces on the first primary lock features 22.

The primary lock retainer features on the terminal stabilizer 24 can eliminate the need for secondary lock features that are typically used to reinforce or back up the primary lock features. With this terminal stabilizer 24 both male and female secondary lock components can be eliminated from the connector design and provide the benefit of reduced overall cost for the electrical connector assembly 10.

While the example presented herein is directed to an electrical connector assembly, other embodiments may be envisioned that are adapted for use with other types of connector assemblies for fiber optic cables, pneumatic tubes, hydraulic tubes, or a hybrid connector assembly including two or more of the items listed above.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electrical connector assembly, comprising:

a first connector body defining a terminal cavity therein;

a male terminal projecting along a terminal axis to a tip and secured within the terminal cavity by a first primary lock feature;

a terminal stabilizer defining an aperture configured to receive the male terminal, wherein the terminal stabilizer is disposed within the first connector body and moveable from a pre-staged position to a staged position;

a first primary lock retaining feature in the form of a rib feature extending parallel to the terminal axis from a first face of the terminal stabilizer and configured to engage the primary lock feature as the terminal stabilizer moves from the pre-staged position to the staged position;

a second connector body defining a second terminal cavity therein and configured to mate with the first connector body; and a female terminal secured within the second terminal cavity by a second primary lock feature and configured to mate with the male terminal, wherein the terminal stabilizer defines a second primary lock retaining feature configured to engage the second primary lock feature as the terminal stabilizer moves from the pre-staged position to the staged position as the first connector body is mated with the second connector body.

2. The electrical connector assembly according to claim 1, wherein the tip of the male terminal is received in the aperture defined by the terminal stabilizer.

3. The electrical connector assembly according to claim 2, wherein the terminal stabilizer is closer to the tip in the pre-staged position than the staged position.

4. The electrical connector assembly according to claim 1, wherein the primary lock retaining feature is disengaged from the primary lock feature when the terminal stabilizer is in the pre-staged position.

5. The electrical connector assembly according to claim 1, wherein the primary lock retaining feature is received within the terminal cavity as the terminal stabilizer is moved from the pre-staged position to the staged position.

6. The electrical connector assembly according to claim 1, wherein the second primary lock retaining feature is a second rib feature extending parallel to the terminal axis from a second face of the terminal stabilizer defining the aperture in a direction opposite to the first face.

7. The electrical connector assembly according to claim 1, wherein the second connector body pushes the terminal stabilizer from the pre-staged position to the staged position as the first connector body is mated with the second connector body.

8. The electrical connector assembly according to claim 7, wherein the terminal stabilizer defines pre-stage locking features configured to retain the terminal stabilizer in the pre-staged position until pushed by the second connector body.

9. The electrical connector assembly according to claim 1, wherein the first primary lock retaining feature engages the first primary lock feature prior to mating the male terminal with the female terminal.

10. The electrical connector assembly according to claim 1, wherein the second primary lock retaining feature engages the second primary lock feature prior to mating the male terminal with the female terminal.

11. The electrical connector assembly according to claim 1, wherein the terminal stabilizer defines a retraction feature configured to move the terminal stabilizer from the staged position to the pre-staged position as the first connector body is unmated from the second connector body.

12. An electrical connector assembly, comprising:

a first connector body defining a first terminal cavity therein;

a male terminal projecting along a terminal axis to a tip and secured within the first terminal cavity by a first primary lock feature;

a second connector body defining a second terminal cavity therein and configured to mate with the first connector body;

a female terminal secured within the second terminal cavity by a second primary lock feature and configured to mate with the male terminal; and a terminal stabilizer defining an aperture configured to receive the male terminal, wherein the terminal stabilizer is disposed within the first connector body and moveable from a pre-staged position to a staged position, wherein the terminal stabilizer defines a means for lockingthe first primary lock feature and a means for lockingthe second primary lock feature as the terminal stabilizer moves from the pre-staged position to the staged position.

13. A method of assembling an electrical connector, comprising:

providing a first connector body having a male terminal secured within a first terminal cavity by a first primary lock feature and having a terminal stabilizer having a first primary lock retaining feature and a second primary lock retainer feature;

providing a second connector body having a female terminal secured within a second terminal cavity by a second primary lock feature;

inserting the first connector body within the second connector body;

moving the terminal stabilizer from a pre-staged position to a staged position; and engaging the first primary lock retaining feature with the first primary lock feature and engaging the secondary lock retaining feature with the second primary lock feature as the terminal stabilizer moves from the pre-staged position to the staged position.

14. The method according to claim 13, further comprising receiving a tip of the male terminal in an aperture in the terminal stabilizer.

15. The method according to claim 14, wherein the terminal stabilizer is closer to the tip in the pre-staged position than the staged position.

16. The method according to claim 13, wherein the first and second primary lock retaining features are disengaged from the first and second primary lock features when the terminal stabilizer is in the pre-staged position.

17. The method according to claim 13, further comprising receiving the first and second primary lock retaining features within the first and second terminal cavities as the terminal stabilizer is moved from the pre-staged position to the staged position.

18. The method according to claim 13, wherein the first and second primary lock retaining features are rib features extending parallel to the terminal axis from a face of the terminal stabilizer defining the aperture.

* * * * *